US007650672B2

(12) United States Patent
Leinders et al.

(10) Patent No.: US 7,650,672 B2
(45) Date of Patent: Jan. 26, 2010

(54) APPARATUS ON A SPINNING PREPARATION MACHINE FOR MONITORING AT LEAST ONE SLIVER

(75) Inventors: Christoph Leinders, Korschenbroich (DE); Franz-Josef Minter, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 726 days.

(21) Appl. No.: 11/349,242

(22) Filed: Feb. 8, 2006

(65) Prior Publication Data

US 2006/0191108 A1 Aug. 31, 2006

(30) Foreign Application Priority Data

Feb. 25, 2005 (DE) ..... 10 2005 009 159

(51) Int. Cl.
*D01G 31/00* (2006.01)

(52) U.S. Cl. ..... 19/0.21; 19/0.23; 19/65 A

(58) Field of Classification Search ..... 19/0.21, 19/0.23, 0.25, 65 A
See application file for complete search history.

(56) References Cited

U.S. PATENT DOCUMENTS

| | | | | |
|---|---|---|---|---|
| 4,549,086 | A * | 10/1985 | Herzer | 250/559.12 |
| 4,609,915 | A | 9/1986 | Erkens | |
| 5,289,381 | A | 2/1994 | Demuth et al. | |
| 5,297,316 | A | 3/1994 | Bernhardt et al. | |
| 6,499,194 | B1 * | 12/2002 | Gresser et al. | 19/239 |
| 2006/0191108 | A1 | 8/2006 | Leinders et al. | |

FOREIGN PATENT DOCUMENTS

| | | |
|---|---|---|
| CH | 540 358 | 9/1973 |
| DE | 33 21 261 | 12/1984 |
| DE | 38 34 110 A1 | 4/1990 |
| DE | 40 10 831 | 10/1991 |
| DE | 40 28 365 A1 | 3/1992 |
| DE | 42 31 795 A1 | 4/1993 |
| DE | 42 43 847 | 6/1994 |
| DE | 199 41 723 A1 | 3/2001 |
| DE | 202 02 780 U1 | 6/2002 |

(Continued)

OTHER PUBLICATIONS

European Search Report dated Jun. 21, 2006, issued in GB0603546.3.

(Continued)

*Primary Examiner*—Shaun R Hurley
(74) *Attorney, Agent, or Firm*—Venable LLP; Robert Kinberg; Steven J. Schwarz

(57) ABSTRACT

In an apparatus on a spinning preparation machine, for example, a flat card, draw frame or the like, for monitoring at least one sliver, having two rotating rollers that form a roller nip through which at least one sliver passes, an optical monitoring arrangement (sensor) that monitors the presence of the sliver is provided in the vicinity of the rollers. To permit a reliable and trouble-free monitoring of sliver breakage in a structurally simple manner, the sensor arrangement is arranged in the region between the shared tangents to the peripheral surfaces of the rollers, the tangents being arranged perpendicularly to the running direction of the fiber, and the optical path of the sensor runs parallel to the axles of the rollers.

25 Claims, 5 Drawing Sheets

FOREIGN PATENT DOCUMENTS

Figure 1:
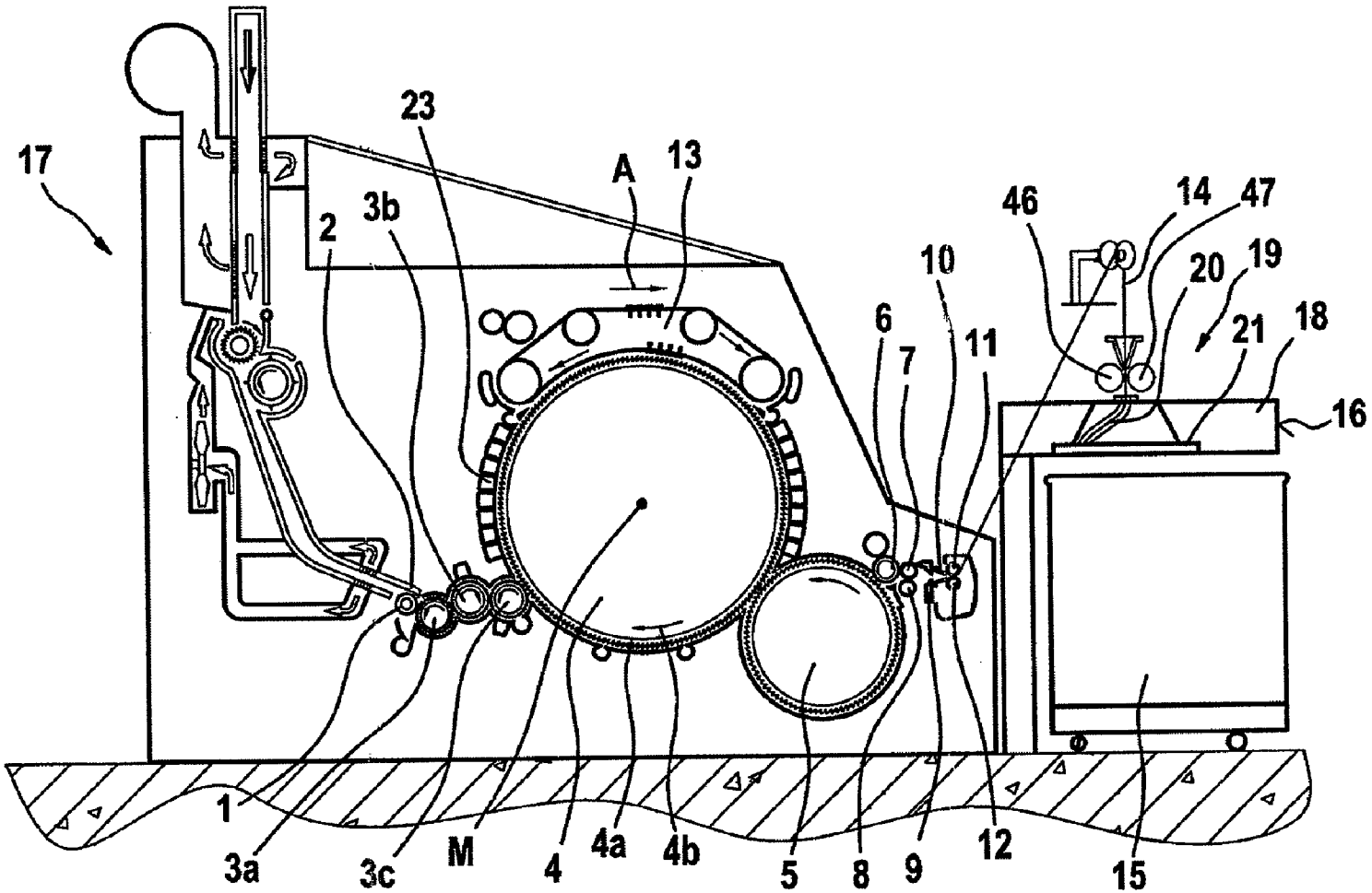

| | | |
|---|---|---|
| EP | 0 072 935 A2 | 3/1983 |
| GB | 1034577 | 6/1966 |
| GB | 1 420 546 | 1/1976 |
| GB | 1 577 167 | 12/1979 |
| GB | 2 108 158 A | 5/1983 |

OTHER PUBLICATIONS

German Search Report dated Feb. 25, 2005 issued in German Application No. 10 2005 009 157.1.
Great Britain Search Report dated Jun. 22, 2006, issued in GB0603547.1.

* cited by examiner

APPARATUS ON A SPINNING PREPARATION MACHINE FOR MONITORING AT LEAST ONE SLIVER

CROSS REFERENCE TO RELATED APPLICATION

This application claims priority from German Patent Application No. 10 2005 009 159.8 dated Feb. 25, 2005, the entire disclosure of which is incorporated herein by reference.

BACKGROUND OF THE INVENTION

The invention relates to an apparatus on a spinning preparation machine, for example, a flat card, draw frame or the like, for monitoring at least one sliver, having two rotating rollers that form a roller nip through which at least one sliver passes.

Feeding of the sliver to the revolving plate of a can coiler is effected at the output of a flat card via take-off rollers. In a known apparatus, (DE 40 28 365 A), an optical sensor, which detects whether a fibre sliver is located in its field of vision or not, is arranged downstream of the take-off rollers. The sensor monitors the presence or absence of the sliver. Absence of the sliver is reported as a malfunction to a machine control. The sensor is arranged away from the roller nip at a distance from the take-off rollers. The optical path of the sensor runs perpendicular to the roller axles. The tension of the sliver changes at a distance from the take-off rollers, that is, the sliver sags to different depths. At relatively high and high sliver speeds, the sliver additionally oscillates parallel to the axles of the take-off rollers, that is, the sliver disappears from the optical path of the sensor, although no sliver funnel is present. Reliable monitoring of sliver breakage is not possible with the known apparatus. In addition, it is inconvenient that the spacing necessitates a separate holding device for the sensor.

It is an aim of the invention to produce an apparatus of the kind described initially that avoids or mitigates the said disadvantages, is in particular of simple construction and permits a reliable and trouble-free monitoring of sliver breakage.

SUMMARY OF THE INVENTION

The invention provides an apparatus on a spinning preparation machine, comprising:

- a pair of rotating rollers forming a nip through which at least one fibre sliver passes in use, each roller having a roller axle; and
- a sensing arrangement defining an optical path in which the sliver can be monitored by the sensing arrangement;

wherein the sensing arrangement is so arranged that the optical path extends, between the rollers, in a direction parallel to the axles of the rollers.

Because the light beam of the sensor extends through the narrowing gap between the rollers, preferably close to the fibre material gripping point and parallel to the axles of the rollers, reliable sliver breakage monitoring can be ensured. In the narrowing gap between the rollers, especially at or in the region of the point of grip, there is a defined guidance of the fibre material, so interruption of the light beam of the sensor by the fibre material is at all times substantially certain. It is furthermore an advantage that the sensor can be mounted on holding or bearing elements that are already present, for example, for the take-off rollers.

Advantageously, the monitoring arrangement comprises a non-contact sensor arrangement (sensor) that is capable of detecting unwanted sliver breakage. Advantageously, the rotating roller pair form a nip from which at least one sliver is discharged. In that case, it is preferred that the roller pair transfers the sliver to a downstream rotating roller pair. Preferably, the roller pair is part of a drafting system, for example, of a draw frame, or of a flat card drafting system. The fibre material may be present in, the form of a composite sliver comprising two or more slivers, or may instead be in the form of a single sliver. Advantageously, the optical path of the sensor is aligned in the direction of the working web of moving fibre material. Advantageously, the sensor is a sensor designed for non-contact sensing.

Advantageously, the sensor is a photoelectric sensor, preferably a light sensor. Advantageously, the sensor is in the form of a reflex sensor. Advantageously, there is associated with the sensor a threshold value detector device, which, following a breakage of the sliver, responds to changes in the output signal of the sensor, preferably a photoreceptor of the photoelectric sensor, by emitting a breakage signal. Advantageously, the threshold value detector device signals a breakage in the sliver only when the exceeding or undershooting of its threshold value initiated by such a breakage continues uninterrupted for a predetermined duration. Advantageously, a display and/or switching device is controllable by the sensor. Preferably, recognition of sliver breakages is effected by means of optical sensors. Advantageously, the sensors are one-way photoelectric barriers with a highly focussed light beam.

Advantageously, the photoelectric barriers are arranged parallel to the axles of the rollers. Advantageously, the photoelectric barriers use a laser beam as detection medium. Advantageously, the light is conducted to the monitoring points by means of light guides. Advantageously, pre-determined machine responses are initiated when a sliver breakage is recognised. Preferably, the responses are effected in dependence on plausibility controls. Preferably, a response is only initiated when the light beam is interrupted for a specific time. Advantageously, the intensity of the light beam emitted by the photoelectric barrier (transmitter) is adaptable to different criteria, for example, the production or the material. Advantageously, the sensitivity of the photoelectric barrier receiver can be adapted to different criteria, for example, the production or the material. Preferably, the sensitivity and/or intensity adjustments of the photoelectric barrier for different production conditions are stored and when conditions are the same are automatically recalled and can be used without manual intervention. As well as or instead of photoelectric barriers or other optical sensors, electronic cameras with illumination means may be used for detecting sliver breakage. The optical path of the sensor may advantageously run immediately adjacent to the peripheral surfaces in the wedge-shaped area of the rollers, or may advantageously run immediately adjacent to the grip line between the rollers. Advantageously, the optical path runs downstream of the roller pair in relation to the working direction.

Preferably, the optical sensor arrangement comprises a transmitter and a receiver. The optical sensor arrangement is advantageously mounted in a stationary holding device. Preferably, the holding device is provided in the region laterally of the roller pair. Preferably, the sensor arrangement is mounted on a framework or the like. Advantageously, the framework is of approximately C-shaped construction. Advantageously, the framework is of approximately forked construction. Advantageously, the framework is of approximately rectangular or square construction. In one embodiment, the sensor monitoring arrangement for sliver breakage and a sensor monitoring arrangement for fibre material build-up are present on the holding device. Advantageously, the sensor monitoring arrangement for sliver breakage is arranged on the holding device in the region between the shared tangents to the peripheral surfaces of the rollers. Advantageously, the optical path of the sensor monitoring arrangement runs parallel to the axle or axles of the roller pair. Advantageously, a shared electrical connection is present for the sensor arrangements for monitoring material build-up and for the sensor arrangement for monitoring sliver breakage. Advantageously, a shared electrical connection for the sensor arrangements is connected to an electrical evaluating arrangement. Advantageously, the evaluation of the electrical signals of the sensor arrangement for monitoring material build-up and of the sensor arrangement for monitoring sliver breakage may be carried out separately. The electrical signals may, having regard to hardware and/or software, be processable as an aggregate signal. The electronic signals may, having regard to hardware and/or software be processable in a single evaluation. Advantageously, on sliver breakage the optical path runs from the transmitter to the receiver. Advantageously, the transmitter and the receiver of the optical monitoring are arranged outside the end faces of the rollers. Advantageously, the transmitter and the receiver of the optical monitoring arrangement are arranged between the axles of the rollers.

The invention also provides an apparatus on a spinning preparation machine, for example, a flat card, draw frame or the like, for monitoring at least one sliver, having two rotating rollers that form a roller nip through which at least one sliver passes, in which apparatus an optical monitoring arrangement (sensor) that monitors the presence of the sliver is provided in the vicinity of the rollers, characterised in that the sensor arrangement is arranged in the region between the shared tangents to the peripheral surfaces of the rollers, the tangents being arranged substantially perpendicular to the running direction of the sliver, and the optical path of the sensor runs parallel to the axles of the rollers.

DETAILED DESCRIPTION OF THE DRAWINGS

Figure 2:
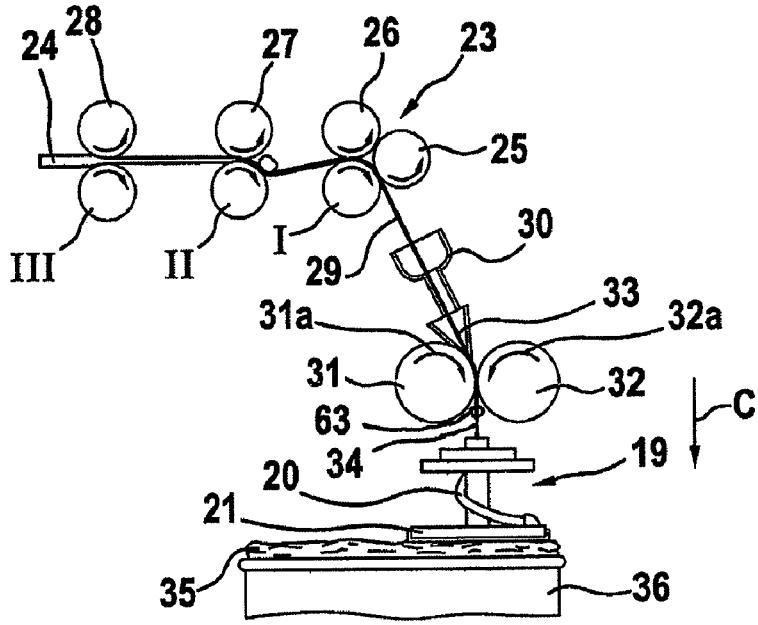
Figure 3:
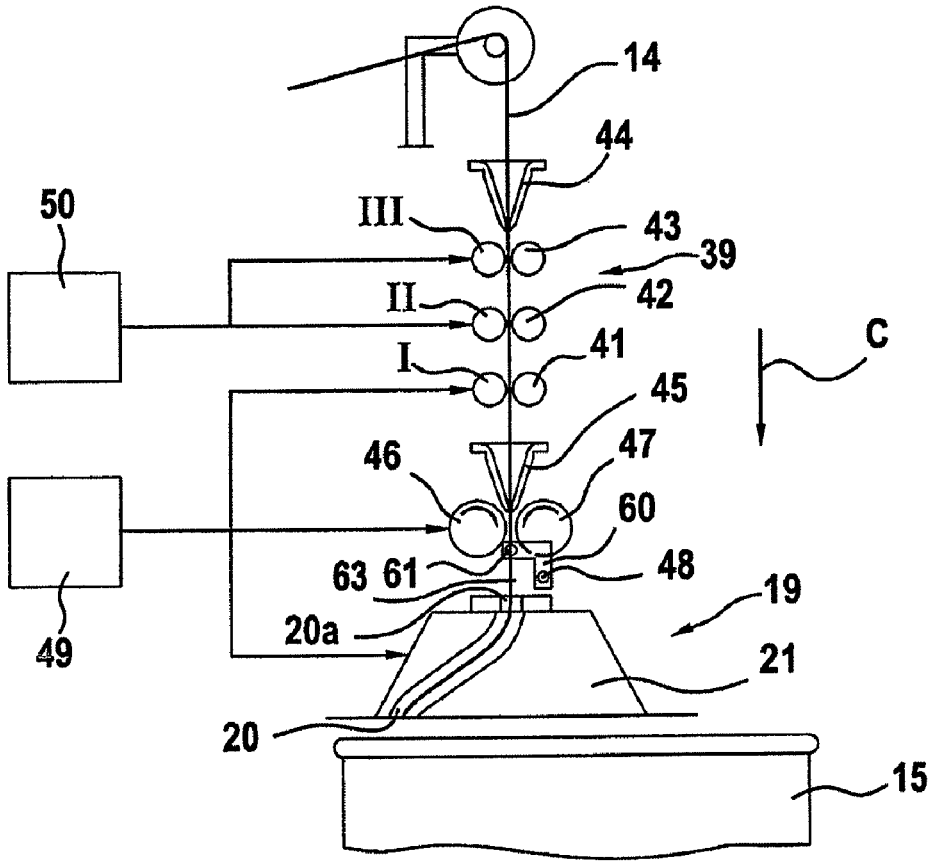
Figure 4:
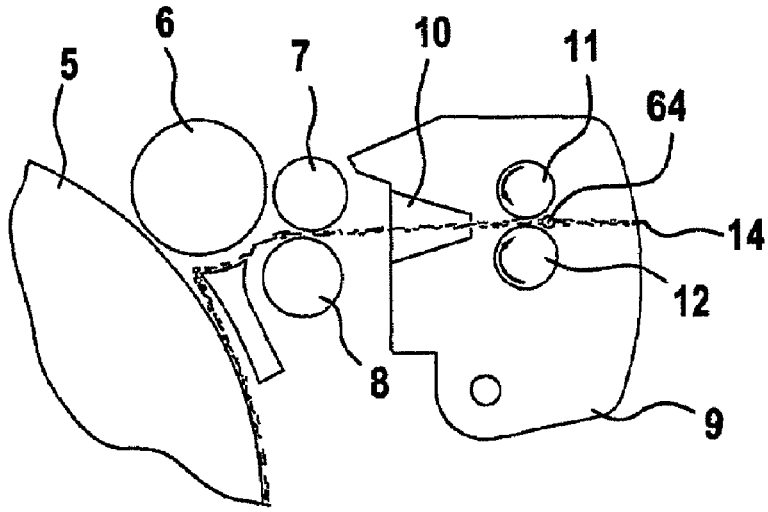
Figure 5A:
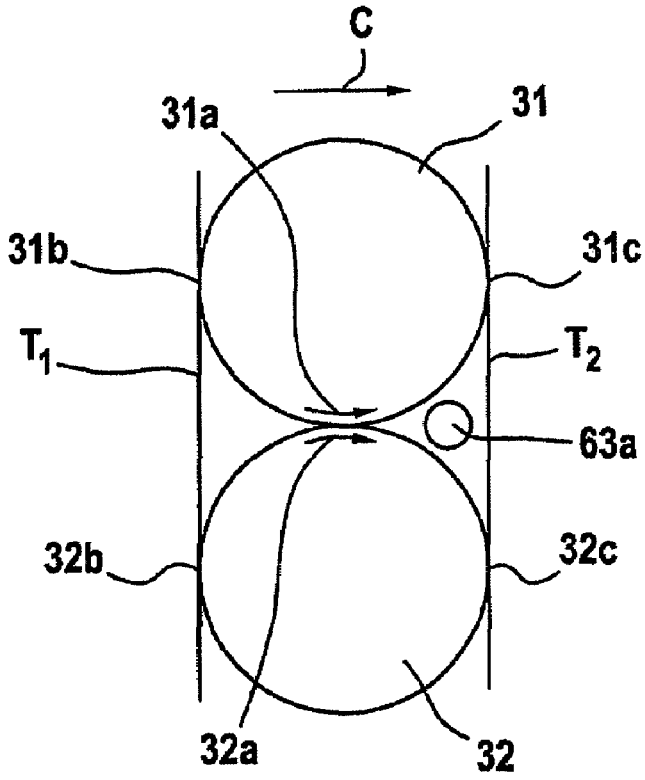
Figure 5B:
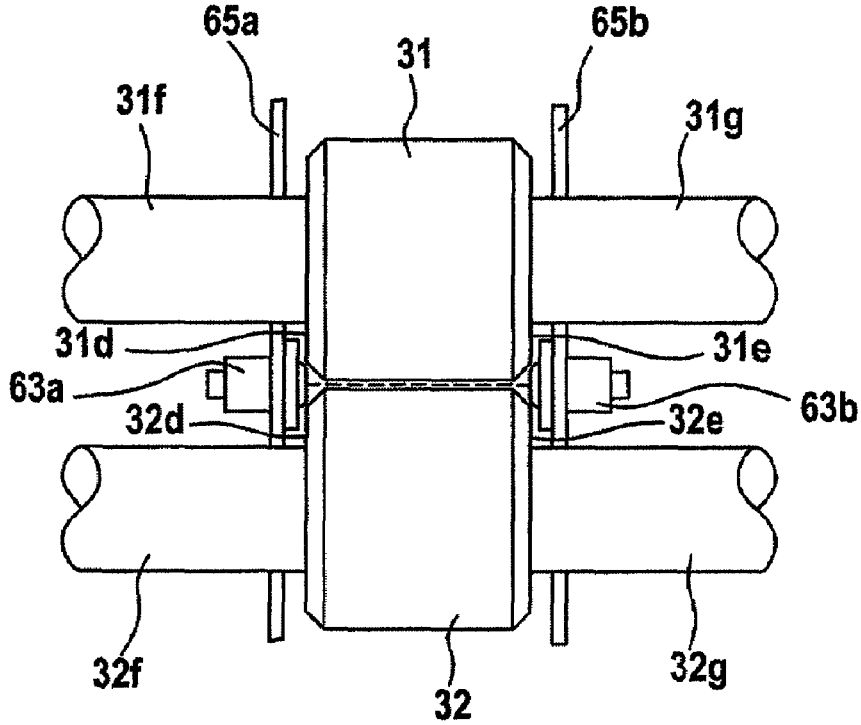
Figure 6A:
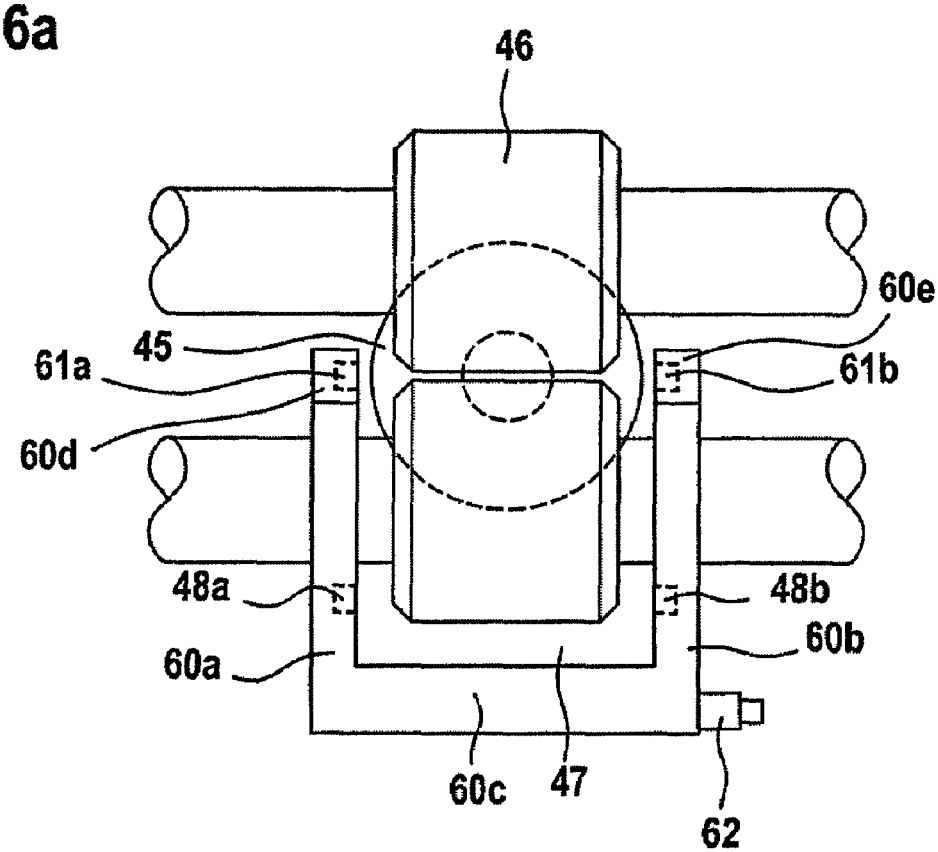
Figure 6B:
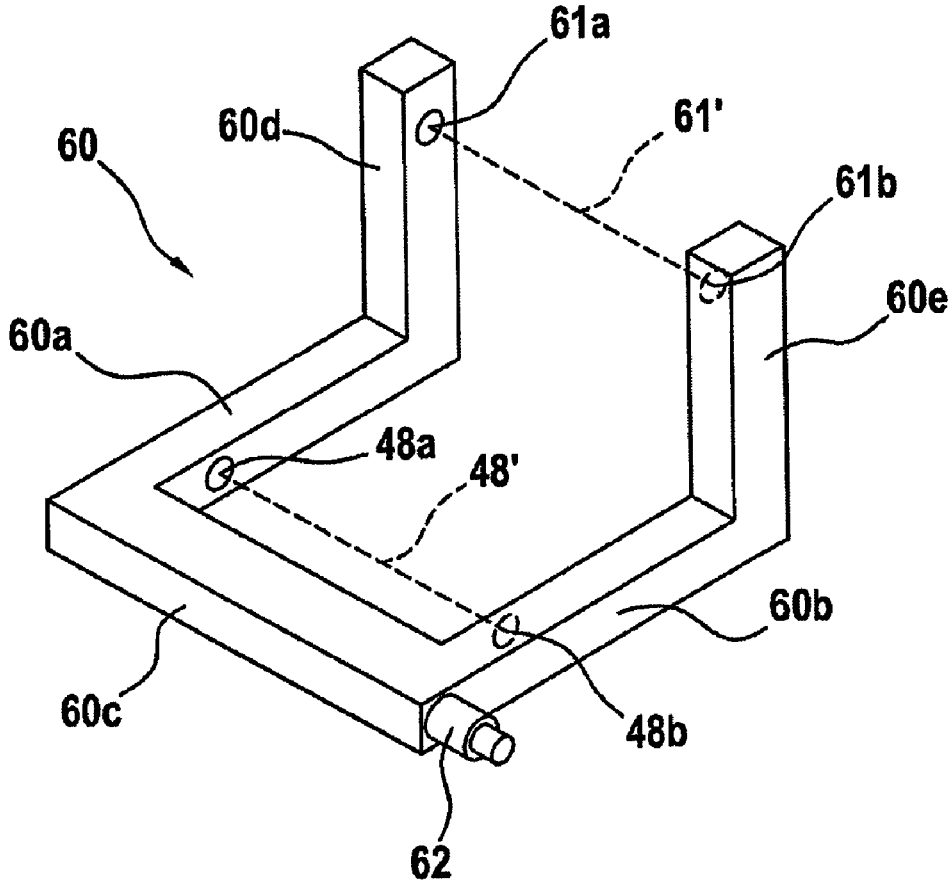

FIG. 1 is a schematic side view of a flat card with can coiler for an arrangement according to the invention for monitoring sliver breakage, FIG. 2 is a schematic side view of the drawing system of a drafting system having an arrangement according to the invention for monitoring sliver breakage, FIG. 3 is a schematic side view of a flat card drafting system having an arrangement according to the invention for monitoring sliver breakage and sliver build-up, FIG. 4 shows a monitoring arrangement according to the invention in the region of the narrowing gap at the outlet of the take-off rollers of a flat card as shown in FIG. 1, FIG. 5*a* is a side view of a pair of take-off rollers with a photoelectric barrier for monitoring sliver breakage, FIG. 5*b* shows the front view corresponding to FIG. 5*a*, FIG. 6*a* shows the front view of a holding device having an arrangement for monitoring sliver breakage and an arrangement for monitoring build-up of fibre material at a pair of take-off rollers, and FIG. 6*b* shows a perspective view of the holding device shown in FIG. 6*a* with electrical connection.

DETAILED DESCRIPTION OF CERTAIN PREFERRED EMBODIMENTS

With reference to FIG. 1, a card, for example, a flat card TC 03 (Trade Mark) made by Trützschler GmbH & Co. KG of Mönchengladbach, Germany, has a feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12, revolving flat 13 with flat guide rollers and flat bars, can 15 and can coiler 16. The directions of rotation of the rollers are shown by respective curved arrows. The letter M denotes the midpoint (axis) of the cylinder 4. The reference numeral 4*a* denotes the clothing and 4*b* denotes the direction of rotation of the cylinder 4. The arrow A denotes the working direction. A tuft feeder 17 is arranged upstream of the flat card. The coiling plate 19 is rotatably mounted in the delivery turntable block 18. The coiling plate 19 comprises a sliver channel 20 having an entry and an exit (see FIG. 3) for the sliver, and a rotary plate 21. As shown with reference to FIG. 4, a photoelectric barrier 64 for monitoring sliver breakage is arranged in the narrowing gap at the outlet between the take-off rollers 11, 12, that is, in the gap between the take-off rollers 11, 12, which narrows in cross-section in the direction towards the region in which the sliver is engaged between the rollers 11, 12. The barrier 64 is thus located between the nip of the rollers 11, 12, on the one hand, and the shared tangents of the rollers 11, 12 that extend perpendicular to the running direction of the sliver, on the other hand.

In the embodiment of FIG. 2, a draw frame, for example a draw frame TD 03 made by Trützschler GmbH & Co. KG, comprises a drafting system 23 having a drafting system inlet and a drafting system outlet. The slivers 24, coming from cans, not shown, enter a sliver guide and, drawn by take-off rollers, are transported past a measuring element. The drawing system, 23 is designed as a 4-over-3 drafting system, that is, it consists of three bottom rollers I, II, III (I being the bottom delivery roller, II being the middle bottom roller and III being the bottom feed roller) and four top rollers 25, 26, 27, 28. Drafting of the composite sliver 24 comprising a plurality of fibre slivers takes place in the drafting system 23. The draft is made up of the preliminary draft and the main draft. The roller pairs 6/III and 5/II form the preliminary draft zone and the roller pairs 27/II and 25, 26, 27/I form the main draft zone. The drawn slivers (fibre web 29) reach a web guide 30 at the drafting system outlet and are drawn by means of the take-off rollers 31, 32 through a sliver funnel 33, in which they are condensed to a sliver 34, which is subsequently laid by way of a can coiler and rotary plate 21 in sliver coils 35 in a can 36. The reference number 63 denotes a photoelectric barrier, which is arranged at the outlet of the take-off rollers 31, 32 in the roller nip and serves to monitor sliver breakage.

FIG. 3 shows an embodiment in which a card drafting system 39 is arranged above the coiling plate 19 between the flat card (see FIG. 1) and the coiling plate 19 (see FIG. 1). The card drafting system 39 is designed as a 3-over-3 drafting system, that is, it consists of three bottom rollers I, II, III and three top rollers 41, 42, 43. An input-measuring funnel 44 is arranged at the entrance to the drafting system 39 and an output-measuring funnel 45 is arranged at the output of the drafting system. Downstream of the output funnel 45 are two take-off rollers 46, 47, which rotate in the direction of the curved arrows and draw the stretched sliver 63 out of the output funnel 45. A photoelectric barrier 48 is arranged between the roller nip of the take-off rollers 46, 47 and the entry region 20*a* of the sliver channel 20, and detects undesirable sliver build-up. The bottom delivery roller I, the take-off rollers 46, 47 and the coiling plate 19 are driven by a main motor 49, the bottom feed and bottom middle roller III respectively II are driven by a variable speed motor 50. The motors 49 and 50 are connected to an electronic control and regulating device (not shown), to which all photoelectric barriers are also connected. The drafting system 23 shown in FIG. 2 is driven in an analogous manner to the flat card drafting system 39 shown in FIG. 3 (main and variable speed motors). A photoelectric barrier 61, which serves to monitor the sliver 63 for breakage (see FIGS. 6*a*, 6*b*), is arranged in the roller nip between the take-off rollers 46, 47.

As shown in FIG. 4, in the case of a flat card (see FIG. 1) a photoelectric barrier 64 that serves to monitor the sliver 14 for breakage is arranged in the narrowing gap at the outlet of the take-off rollers 11, 12.

FIGS. 5*a*, 5*b*, show an arrangement suitable for use in the drafting system in a draw frame (FIG. 2). A photoelectric barrier 63 comprising a transmitter 63*a* and a receiver 63*b* is arranged in the narrowing gap at the outlet of the take-off rollers 31, 32, and serves to monitor the sliver 34 for breakage. The take-off rollers 31 and 32 rotate in the direction of the curved arrows 31*a* and 32*a* respectively. $T_1$ and $T_2$ denote shared tangents, which are arranged perpendicular to the running direction c of the sliver. The shared tangent $T_1$ contacts the take-off rollers 31, 32 at the entrance to the narrowing gap at a point 31*b* and 32*b*, and the shared tangent $T_2$ contacts the take-off rollers 31, 32 at the exit of the wedge-shaped area, at a point 31*c* and 31*c* respectively (FIG. 5*a*).

As shown in FIG. 5*b*, the transmitter 63*a* and the receiver 63*b* are each arranged away from the end faces 31*d*, 31*e* and 32*d*, 32*e* respectively of the take-off rollers 31, 32. In this manner, it is possible to position the optical path between transmitter 63*a* and receiver 63*b* as close as possible to the roller nip between the take-off rollers 31, 32. In the space (narrowing gap) between tangent $T_2$ and the gripping point between the rollers 31, 32 there is only the highly focussed beam. The transmitter 63*a* and the receiver 63*b* are also arranged away from the narrow gap owing to reasons of space. The transmitter 63*a* is arranged in the space between the axles 31*f* and 32*f* of the rollers 31 and 32 respectively and the receiver is arranged in the space between the axles 31*g* and 32*g* of the rollers 31 and 32 respectively. The transmitter 63*a* is mounted on a holding element 65*a* and the receiver 63*b* is mounted on a holding element 65*b*.

FIG. 6*a* shows the front view onto the roller nip at the outlet of the take-off rollers. 46, 47 of the card drafting system 39 of FIG. 3. An approximately fork-shaped holding element 60 is associated with the region at, and upstream of, the roller nip; as shown in FIG. 6*b*, this element comprises two parallel longitudinal struts 60*a*, 60*b*, forming an open, approximately U-shaped rectangle, which at one end are joined to one another by a cross strut 60*c*. Respective extensions 60*d* and 60*e* projecting at right angles are mounted at the two other ends of the longitudinal struts 60*a*, 60*b*. A photoelectric barrier 48 is arranged between the insides of the longitudinal struts 60*a*, 60*b*, such that the transmitter 48*a* is mounted on the longitudinal strut 60*a* and the receiver 48*b* is mounted on the longitudinal strut 60*b*. The optical path between transmitter 48*a* and receiver 48*b* is marked 48'. A photoelectric barrier 61 is arranged between the insides of the extensions 60*d* and 60*e*, such that the transmitter 61*a* is mounted on the extension 60*d* and the receiver 61*b* is mounted on the extension 60*e*. The optical path between transmitter 61*a* and receiver 61*b* is marked 61'. 62 denotes a shared electrical connection for the photoelectric barriers 48 and 61. As shown in FIG. 6*a*, the holding element 60 is associated with the roller outlet of the take-off rollers 46, 47 in such a way that the optical path 61'—a highly focussed beam—extends within the roller nip (wedge-shaped area) parallel to the axles of the take-off rollers 46, 47. The photoelectric barrier 61 forms a means monitoring sliver breakage. When the light beam 61' between transmitter 61*a* and receiver 61*b* is interrupted, a sliver 63 is present (see FIG. 3). When the light beam 61' runs from the transmitter 61*a* to the receiver 61*b* without interruption, no sliver 63 is present (fault). It is advantageous for the sliver 63 to be guided in a defined manner within the roller nip (narrowing gap) and especially in the vicinity of or even at the fibre material gripping point (nip) between the two take-off rollers 46, 47, that is, there are no deviations, vibrations or the like-which could cause the sliver 63 to leave the optical path 61'.

FIGS. 5*a*, 5*b*, show an arrangement suitable for use in the drafting system in a draw frame (FIG. 2). A photoelectric barrier 63 comprising a transmitter 63*a* and a receiver 63*b* is arranged in the narrowing gap at the outlet of the take-off rollers 31, 32, and serves to monitor the sliver 34 for breakage. The take-off rollers 31 and 32 rotate in the direction of the curved arrows 31*a* and 32*a*respectively. $T_1$ and $T_2$ denote shared tangents, which are arranged perpendicular to the running direction c of the sliver. The shared tangent $T_1$ contacts the take-off rollers 31, 32 at the entrance to the narrowing gap at a point 31*b* and 32*b*, and the shared tangent $T_2$ contacts the take-off rollers 31, 32 at the exit of the wedge-shaped area, at a point 31*c* and 32*c* respectively (FIG. 5*a*).

Although the foregoing invention has been described in detail by way of illustration and example for purposes of understanding, it will be obvious that changes and modifications may be practised within the scope of the appended claims.

What is claimed is:

1. An apparatus on a spinning preparation machine, comprising:

a pair of rotating rollers forming a nip through which at least one fibre sliver passes in use, each roller having a roller axle, wherein the pair of rollers defines an upstream common tangential plane extending substantially perpendicular to the fibre sliver, and a downstream common tangential plane extending substantially perpendicular to the fibre sliver; and a sensing arrangement defining an optical path in which the sliver can be monitored by the sensing arrangement;

wherein the sensing arrangement is so arranged that the optical path extends, between the rollers, in a direction parallel to the axles of the rollers, and the optical path is located between the upstream common tangential plane and the downstream common tangential plane.

2. An apparatus according to claim 1, in which the optical path is located between the upstream common tangential plane and the roller nip.

3. An apparatus according to claim 1, in which the optical path is located between the downstream common tangential plane and the roller nip.

4. An apparatus according to claim 1, in which the sensing arrangement comprises a non-contact sensor that detects unwanted sliver breakage.

5. An apparatus according to claim 4, in which the sensor comprises a photoelectric sensor.

6. An apparatus according to claim 1, in which the sensing arrangement comprises a reflex sensor.

7. An apparatus according to claim 1, further comprising a threshold value detector device, that responds to changes in an output signal of the sensor by emitting a breakage signal.

8. An apparatus according to claim 1, in which the sensing arrangement comprises a one-way photoelectric barrier which utilises a laser beam as a detection medium.

9. An apparatus according to claim 1, further comprising a control device that initiates pre-determined machine responses when a sliver breakage is recognised.

10. An apparatus according to claim 9, in which the responses are effected in dependence on plausibility controls.

11. An apparatus according to claim 1, wherein the sensing arrangement comprises a transmitter and a receiver, at least one of which is adjustable for adapting the sensing arrangement to different criteria.

12. An apparatus according to claim 11, in which the criteria include production conditions, and the adjustments for different production conditions are stored and when conditions are the same are automatically recalled and can be used without manual intervention.

13. An apparatus according to claim 1, in which the sensing arrangement comprises electronic cameras with illumination means for detecting sliver breakage.

14. An apparatus according to claim 1, in which the sensing arrangement is mounted in a stationary holding device.

15. An apparatus according to claim 14, in which the holding device includes a framework comprising a bifurcated portion.

16. An apparatus according to claim 1, further comprising a sensor monitoring arrangement for fibre material build-up.

17. An apparatus according to claim 16, in which the sensor monitoring arrangement is outside a region between the upstream common tangential plane and the downstream common tangential plane.

18. An apparatus according to claim 16, in which the optical path runs parallel to the axle or axles of the roller pair.

19. An apparatus according to claim 1, in which a shared electrical connection is present for the sensor monitoring arrangement and for the sensing arrangement.

20. An apparatus according to claim 1, wherein the sensing arrangement comprises a transmitter and a receiver defining the optical path therebetween, in which on sliver breakage the optical path runs unbroken from the transmitter to the receiver.

21. An apparatus according to claim 1, in which each roller defines a pair of end faces, and the sensing arrangement comprises a transmitter and a receiver both located outside the end faces of the roller.

22. An apparatus according to claim 1, in which the pair of rotating rollers transfers the sliver to a downstream rotating roller pair, and the sensing arrangement is downstream of the nip of the pair of rotating rollers.

23. An apparatus according to claim 1, in which the pair of rotating rollers is part of a drafting system.

24. An apparatus according to claim 23, in which the drafting system is part of a draw frame or a flat card drafting system.

25. Apparatus on a spinning preparation machine, for monitoring at least one sliver, comprising:

two rotating rollers that form a roller nip through which the at least one sliver passes, each roller having a peripheral surface, wherein the peripheral surfaces of the two rotating rollers define an upstream shared tangent that is substantially perpendicular to a running direction of the sliver, and a downstream shared tangent that is substantially perpendicular to the running direction of the sliver; and an optical sensing arrangement that monitors the presence of the sliver between the upstream shared tangent and the downstream shared tangent, wherein the optical sensing arrangement defines an optical path running parallel to the axes of the rollers.

* * * * *

UNITED STATES PATENT AND TRADEMARK OFFICE

CERTIFICATE OF CORRECTION

PATENT NO. : 7,650,672 B2
APPLICATION NO. : 11/349242
DATED : January 26, 2010
INVENTOR(S) : Leinders et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1024 days.

Signed and Sealed this

Twenty-third Day of November, 2010

David J. Kappos

David J. Kappos
*Director of the United States Patent and Trademark Office*